US007063031B2

(12) United States Patent
Earl, Jr. et al.

(10) Patent No.: US 7,063,031 B2
(45) Date of Patent: Jun. 20, 2006

(54) WAKE CONTROL DEVICE FOR BOAT

(75) Inventors: Thomas C. Earl, Jr., Cape Carol, FL (US); Joseph Zsido, Benton, IL (US)

(73) Assignee: Pivotal Designs Inc., Benton, IL (US)

( * ) Notice: Subject to any disclaimer, the term of this patent is extended or adjusted under 35 U.S.C. 154(b) by 0 days.

(21) Appl. No.: 10/856,589

(22) Filed: May 28, 2004

(65) Prior Publication Data

US 2005/0263059 A1 Dec. 1, 2005

(51) Int. Cl.
*B63H 25/06* (2006.01)

(52) U.S. Cl. ..... 114/162; 440/51

(58) Field of Classification Search ..... 114/162, 114/274, 280, 281, 284, 285, 286, 253; 441/69; 440/51

See application file for complete search history.

(56) References Cited

U.S. PATENT DOCUMENTS

| | | | | | |
|---|---|---|---|---|---|
| 2,972,326 | A | * | 2/1961 | Simpson | 441/69 |
| 3,079,885 | A | * | 3/1963 | Cooke | 441/69 |
| 3,406,652 | A | * | 10/1968 | Mettetal, Jr. | 440/56 |
| 3,722,455 | A | * | 3/1973 | Carpenter | 440/56 |
| 3,817,202 | A | * | 6/1974 | Holtermann | 440/66 |
| 4,320,546 | A | * | 3/1982 | Knox | 441/74 |
| 4,500,298 | A | * | 2/1985 | Hall et al. | 440/62 |
| 5,224,889 | A | * | 7/1993 | Hickey | 440/71 |
| 5,315,951 | A | | 5/1994 | Finkl | |
| 5,326,294 | A | * | 7/1994 | Schoell | 440/79 |
| 5,549,071 | A | | 8/1996 | Pigeon et al. | |
| 5,638,765 | A | * | 6/1997 | Poulos | 114/274 |
| 5,860,384 | A | * | 1/1999 | Castillo | 114/280 |
| 6,012,408 | A | | 1/2000 | Castillo | |
| 6,309,265 | B1 | * | 10/2001 | Oguma | 440/61 R |
| 6,603,402 | B1 | * | 8/2003 | Lentine et al. | 340/573.6 |

* cited by examiner

*Primary Examiner*—Stephen Avila
(74) *Attorney, Agent, or Firm*—Wood, Phillips, Katz, Clark & Mortimer

(57) ABSTRACT

A wake control device for a boat, including a mounting member pivotally securable to the boat aft for pivoting about a first axis substantially transverse to the boat aft, a rudder member secured to the mounting member for pivoting about a second axis substantially perpendicular to the first axis, a drive selectively controlling the pivotal position of the mounting member about the first axis, and a fin extending laterally relative to the rudder member. Such a wake control device, with or without pivoting about the second axis, may also be secured directly to an outboard drive as well. A control manually operable by a wake boarder while being towed remotely controls the pivotal position controlling drive.

31 Claims, 5 Drawing Sheets

WAKE CONTROL DEVICE FOR BOAT

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward boats for skiing and wake boarding, and particularly toward controlling the wake generated by, and enhancing the maneuvering of, boats.

BACKGROUND OF THE INVENTION AND TECHNICAL PROBLEMS POSED BY THE PRIOR ART

Water sports are popular recreation, exercise and, in some cases, competitive activities which are enjoyed virtually anywhere which has reasonably warm weather and a body of water. Among the most popular of water sports using a boat are water skiing and, to a growing degree, wake boarding. Wake boarders ride a device known as a wake board while being pulled by a tow line or rope behind a suitable power boat (in the same manner that a water skier is pulled behind a boat). Both wake boarders and water skiers will often maneuver laterally across the wake produced by the moving boat in a slalom-like fashion, with the passage of the wake board or skis over the wake lifting the participant into the air, allowing the wake boarder or skier the opportunity, if desired, to perform various flips or other tricks prior to landing back onto the surface of the water.

Obviously, the ride of the wake boarder or skier will in large part be dependent on the level of the wake of the boat being pulled. Moreover, different level wakes may be desirable for different types of tricks. Thus, depending on the combination of tricks which a wake boarder or water skier may desire to perform, varying wake levels may be desirable during a single ride.

Some adjustments to the wake level of a boat having an outboard motor may be accomplished by changing the orientation of the propeller within the water. However, such adjustments are somewhat limited and not easily obtainable with boats that include inboard motors.

A variety of devices have heretofore also been provided to assist in creating a desired wake in such uses. Some devices change the trim of the boat through the provision of ballast in the boat, such as pumping water into or out of bladders to cause the rear of the boat to sit lower or higher in the water, or to simply add weight such as concrete blocks to the boat. However, such devices may only change the boat trim slowly, and therefore quick changes to the wake level may not be quickly accomplished. This may not only generally frustrate the wake boarder or skier, but also may make a quick succession of different tricks requiring different wake levels impossible. Further, devices of this type may be dangerous if not used correctly as they may cause the boat to sit too low in the water.

U.S. Pat. No. 5,860,384 discloses a hydrofoil which is pivotably secured to the transom of a boat, and which may be pivoted to adjust the wake provided by the boat. However, boats using this device and others such as disclosed, for example, in U.S. Pat. No. 5,549,071 may not be ideally maneuvered. Moreover, while such devices may assist in controlling the boat wake, it is necessary for the wake boarder or skier being towed to communicate the desired wake to the boat driver, or for the boat driver to anticipate the desires of the wake boarder or skier, or for the wake boarder or skier to adjust what he or she does in response to the wake level selected by the boat driver.

The present invention is directed toward overcoming one or more of the problems set forth above.

SUMMARY OF THE INVENTION

In one aspect of the present invention, a wake control device for a boat having an aft is provided, including a mounting member pivotally securable to the boat aft for pivoting about a first axis substantially transverse to the boat aft, a rudder member secured to the mounting member for pivoting about a second axis substantially perpendicular to the first axis, a drive selectively controlling the pivotal position of the mounting member about the first axis, and a fin extending laterally relative to the rudder member.

In a form of this aspect of the invention, the first and second axes are non-intersecting.

In another form of this aspect of the invention, the second axis is fixed relative to the mounting member.

In still another form of this aspect of the invention, the device is in combination with a boat having a water propulsion drive generating a water stream, wherein the second axis extends through the water stream. In further forms, the water propulsion device is an inboard motor on the boat, or an outboard drive on the boat, or the fin is positioned in the water stream. In another further form, there is a controller for the pivotal position controlling drive, a tow rope is secured to the boat at one end and has a securement for a skier or wake boarder remote from the one end, with a manually operable control for the controller located at the tow rope securement. In further forms, a wire connection is along the tow rope connecting the controller and the manually operable control, the manually operable control includes a wireless connection to the controller, or the fin is pivotable about the first axis between a normal position aligned with the bow of the boat and a maximum wake assisting position (where, in a still further form, the normal position and the maximum wake assisting position are pivotally spaced about 12° apart around the first axis.

In yet another form of this aspect of the present invention, the fin is curved upwardly on opposite lateral ends and centered on the rudder member.

In still another form, the pivotal position controlling drive comprises at least one selectively expandable drive member having one end pivotally securable to the boat aft and the other end pivotally secured to the mounting member. In a further form, the drive member is a first piston and cylinder and, in a still further form, includes a second piston and cylinder where the first and second pistons and cylinders are symmetrically disposed on opposite sides of the mounting member.

In yet another form of this aspect of the invention, the fin is centered on the rudder member. In a further form, the fin is fixed to the bottom end of the rudder member.

In another aspect of the present invention, a wake control device is provided for a boat propelled by an outboard drive having a propeller drive, including a rudder member securable to a position spaced behind the outboard drive, where the rudder member is pivotable about a lateral axis relative to the outboard drive when secured thereto. The lateral axis is substantially transverse to the outboard drive and perpendicular to the propeller axis. A drive selectively controls the pivotal position of the rudder member about the first axis, and a fin extends laterally relative to the rudder member and defines a surface substantially aligned with the propeller axis.

In one form of this aspect of the invention, the rudder member is also pivotable about a second axis substantially perpendicular to the first axis.

In another form of this aspect of the present invention, the wake control device is in combination with the outboard drive and propeller, wherein the propeller is adapted to generate a water stream and propel the boat and the fin is positioned in the water stream. In one further form, a controller is provided for the pivotal position controlling drive associated with the rudder and fin, and a remote control for the controller is manually operable by a skier or wake boarder remote from the boat. In another further form, the fin is pivotable about the lateral axis between a normal position aligned with the propeller axis and a maximum wake assisting position where, in a still further form, the normal position and the maximum wake assisting position are pivotally spaced about 12° apart around the lateral axis.

In still another aspect of the present invention, the fin is curved upwardly on opposite lateral ends and centered on the rudder member.

In yet another aspect of the present invention, the pivotal position controlling drive includes at least one selectively expandable drive member having one end pivotally securable to the boat aft and the other end pivotally secured to the mounting member. In one further form, the drive member is a first piston and cylinder, and in a still further form, there is a second piston and cylinder, where the first and second pistons and cylinders are symmetrically disposed on opposite sides of the mounting member.

In still another form of this aspect of the present invention, the fin is centered on the rudder member and, in a still further form, the fin is fixed to the bottom end of the rudder member.

In still another aspect of the present invention, a device for controlling the wake of a boat includes a wake assisting device securable to the rear of the boat, a controller for the wake assisting device, and a manually operable control remotely operable by a skier or wake boarder being pulled by the boat.

In one form of this aspect of the present invention, a tow rope is securable to the boat at one end and includes a securement for a skier or wake boarder remote from the one end, wherein the manually operable control is located at the securement. In further forms, a wire connection along the tow rope connects the controller and the manually operable control, and/or the manually operable control includes a wireless connection to the controller.

DETAILED DESCRIPTION OF THE INVENTION

Figure 1:
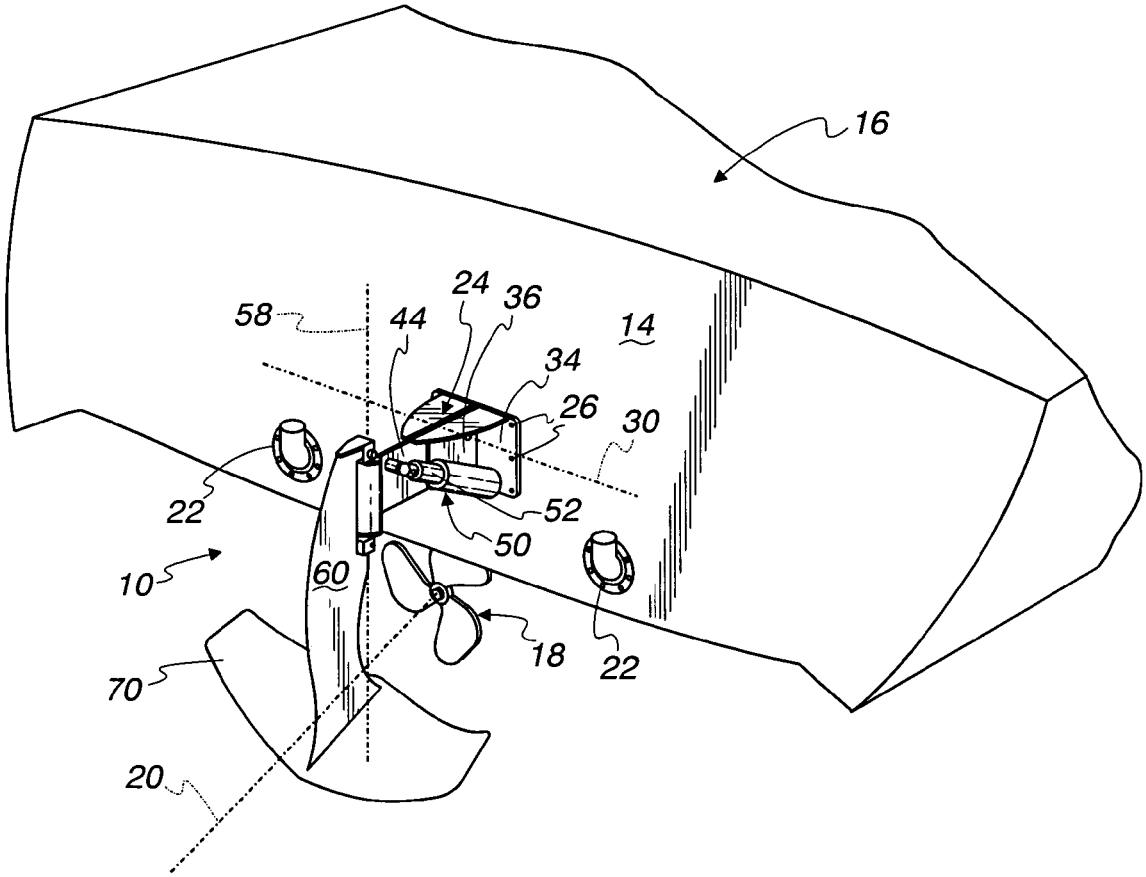
FIG. 1 is a perspective view of the aft of a boat having a wake control device according to the present invention secured thereto.

FIG. 1 illustrates a first embodiment of a wake control device 10 according to the present invention, as mounted on the transom 14 of a boat 16 having an inboard motor for a propulsion drive 18 (e.g., a propeller rotating about a propeller axis 20 as illustrated in FIG. 1) which generates a water stream behind it as it drives the boat 16. (While reference herein is made to a "boat", it should be understood that the present invention may be advantageously used particularly with any type of watercraft which may be used to pull a wake boarder and/or skier.) While illustrated as connected to the transom 14 of the boat 16, it should however be understood that it would be within the scope of the present invention to secure the wake control device 10 in any suitable manner to any component at the boat aft so that the device 10 will be positioned rearwardly of the propulsion drive and adjustably positionable, both as described in further detail below. Further, it should be understood that the present invention could advantageously be used with essentially any boat propulsion drive including, for example, inboard motors, outboard motors, inboard/outboard drives, jet drives and dual engine/dual propeller drives, where the wake control device would be positioned rearwardly of the propulsion drive as described in further detail below.

As is known, exhaust ports 22 for the inboard motor are seen in FIG. 1. It should be understood that a controlled rudder would typically be provided behind the propeller 18 for maneuvering the boat 16, but the rudder has been omitted in FIG. 1 for clarity of illustration of the present invention.

The wake control device 10 includes a mounting bracket 24 which may be suitably secured to the boat transom 14, for example by rivets, screws or bolts 26 through suitable holes 28 in the bracket 24.

The bracket 24 defines a first pivot axis 30 which is lateral or transverse to the boat 16 and, when the boat 16 is level, extends substantially horizontal. It should be understood, however, that the first pivot axis 30 is fixed relative to the boat 16 so that when the boat 16 leans (e.g., when turning), the first pivot axis 30 will similarly lean away from a horizontal orientation.

In the embodiment illustrated in FIGS. 1–5, the bracket 24 includes a mounting plate 34 which is adapted to be securely mounted against the transom 14 as previously described. Further, a pair of spaced parallel flanges 36 extend rearwardly from the plate 34 at a substantially perpendicular orientation to the plate 34. Suitable reinforcing flanges 38 may be provided as illustrated to rigidly support the parallel flanges 36 in the desired described orientation.

It should be appreciated that the bracket 24 illustrated is merely one suitable structure which may be used. Once an understanding of the present invention is had, it will be appreciated by those skilled in the art that the bracket may take virtually any form which will suitably provide a secure pivot with the pivot axis 30 oriented as described herein. For example, the plate 34 and flanges 36 could be formed of two separate "L" members, or of a base plate having the flanges suitably secured thereto by welding or the like. Moreover, it should be understood that the components of the present invention may be formed of any material suitable for use in water environments and having sufficient strength to maintain their structural integrity while encountering the stresses and forces which can be expected during use. For example, stainless steel and/or aluminum may advantageously be used.

A mounting link 44 is suitably secured between the bracket mounting plates 34 for pivoting about the first pivot axis 30, for example by a pivot sleeve 46 axially aligned with the first pivot axis 30 and extending through, and suitably secured in, aligned openings in the mounting plates 34 and the mounting link 44. It should be understood, however, that still other pivotal linkages could be used within the scope of the present invention. However, it should be appreciated that the illustrated connection will advantageously limit the downward pivoting of the mounting link as a result of abutment of the bottom (forward) corner of the mounting link 44 with the mounting plate 34, and thereby ensure a reliable lowered position of the wake control device 10 as described in further detail hereafter.

Figure 2:
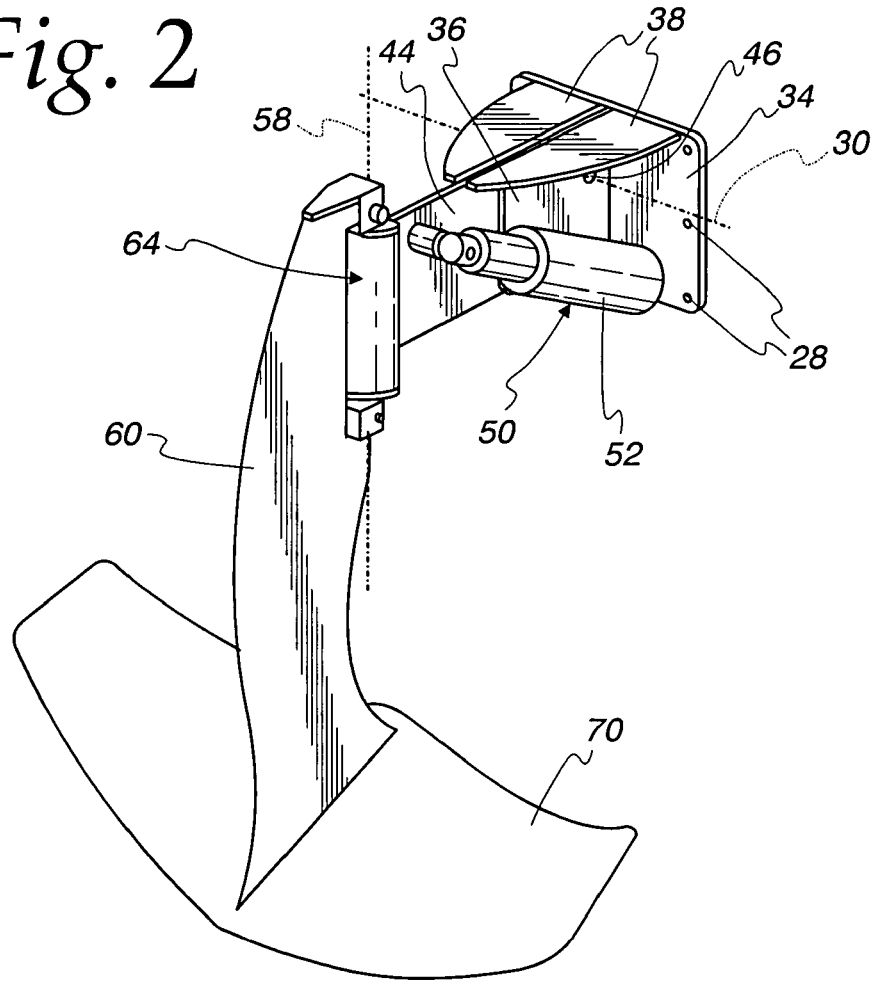
FIG. 2 is a perspective view of a wake control device according to the present invention.

At least one drive 50 is provided to control the pivotal position of the mounting link 44 about the first pivot axis 30. As illustrated in FIGS. 1–2, the drive 50 may advantageously include a cylinder and piston 52 having one end secured to a bracket mount 54 and the opposite end secured to a link mount 56. Preferably, a pair of synchronized drives 50 may be provided on both sides of the flanges 36 and link 44 to ensure smooth controlled operation, as described below, in selectively positioning the link 44 relative to the bracket 24. It should be recognized, however, that essentially any drive which may be suitably controlled to pivot the mounting link 44 relative to the bracket 24 with sufficient force necessary to change and maintain the desired pivoted position given the forces encountered including, for example, hydraulic cylinders, pneumatic cylinders, ball screws, and suitable torque drives.

Pivotally secured to the rear end of the mounting link 44 about a substantially vertical second pivot axis 58 (when the boat 16 is level) is a rudder member 60, which is also generally vertically oriented. A suitable pivot 64 is provided between the mounting link 44 and the rudder member 60 may advantageously freely pivot from side to side as it passes through the water, depending on the flow of the water as described further below.

(While the first and second pivot axes 30, 58 do not intersect and, therefore, do not form a right angle, they are generally oriented perpendicularly to one another in the same sense that non-intersecting horizontal and vertical axes are perpendicular to one another. Since the boat will not remain level at all times, and therefore the first and second pivot axes 30, 58 will not remain horizontal and vertical at all times, reference herein will be made to the axes 30, 58 being perpendicular to one another in this same sense [i.e., where each axis 30, 58 lies in one plane which is perpendicular to the other axis]. As such, references herein to the axes 30, 58 being perpendicular should not be taken to indicate that the axes 30, 58 are required or intended to intersect.)

Figure 3:
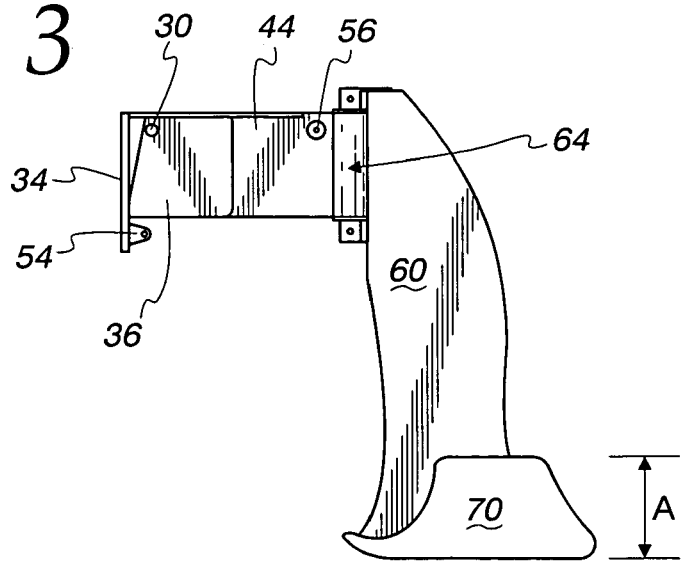
FIG. 3 is a side view of the wake control device of FIG. 2, with the pivotal drive removed.
Figure 4:
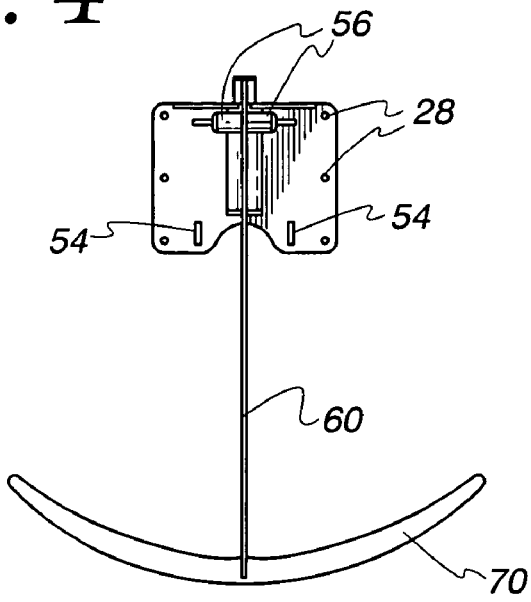
FIG. 4 is a rear view of the wake control device of FIG. 3.
Figure 5:
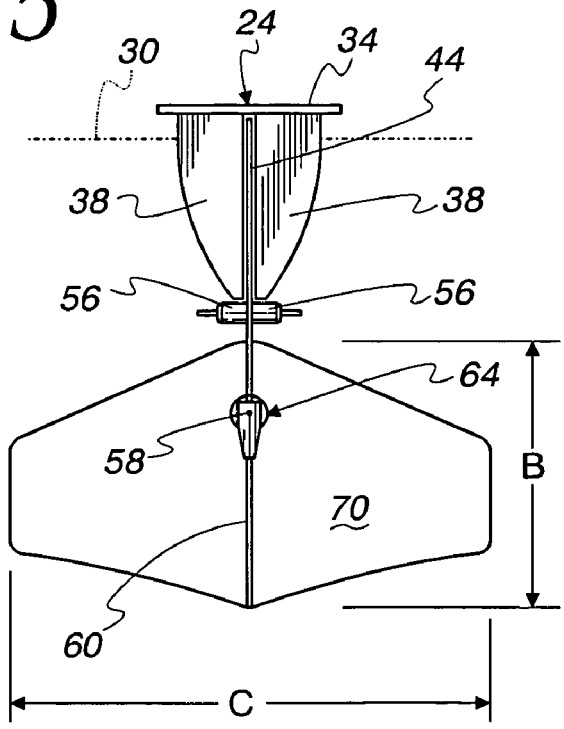
FIG. 5 is a top view of the wake control device of FIG. 3.

A laterally extending fin 70 is secured to the bottom of the rudder member 60, which fin 70 may advantageously be symmetrically arcuate as illustrated in FIG. 3. The surface of the fin 70 is generally straight in the forward direction (when the rudder member 60 is aligned straight with the mounting link 44), with the fin surface being essentially horizontal (when the boat 16 is level) in the forward direction when the device 10 is in its down, lowered position. In such an orientation, the fin 70 will have minimal effect on the boat wake. While it should be understood that different shapes of the fin 70 could be used within the scope of the present invention, a fin 70 as illustrated has been demonstrated to be advantageous, where the fin curves up approximately 8" (A in FIG. 3), and has a depth of approximately 14" and a width of 27" (B and C in FIG. 5).

The rudder member 60 and fin 70 are, in accordance with the present invention, advantageously supported so as to be positioned in the water stream of the propulsion drive 18 as illustrated in FIG. 1. Where used with a dual propeller drive, in which the propellers typically rotate in opposite directions to jointly generate a water stream to the center of the boat, the rudder member 60 and fin 70 would advantageously be positioned at the center rear of the boat, in that water stream.

The pivoting of the rudder member 60 may advantageously be limited, for example to prevent pivoting beyond 45° to either side of the mounting link 44, to prevent the rudder member 60 and attached fin 70 from pivoting too far to a position in which the fin 70 and/or rudder member 60 may inadvertently bump other components at the rear of the boat 16, such as the propeller, particularly when the boat 16 is out of the water.

In use, from the lowered position (FIG. 3), the drive 50 may be extended to pivot the rudder member 60 and attached fin 70 up to increase the wake created by the boat 16. It should be appreciated that as this pivoting increases gradually, the wake created by the boat 16 will also increase gradually. As a result, a wake boarder or skier may be provided with a wide range of wakes (not only in wake level, but also wake shape) which he or she may use dependent upon the wake desired by the wake boarder or skier, with different persons having different desired wakes being able to be readily accommodated by a single boat 16 having the wake control device 10 according to the present invention.

A limited range of pivotal motion of the mounting link 44 of about 12° up (counterclockwise in FIG. 3) from the lowered position to the maximum wake assisting position has been found to be advantageous, although it should be appreciated that still other degrees of permissible pivoting of the mounting link 44 could be used within the scope of the invention. Further, it should be appreciated that by positioning the fin 70 rearwardly of the first pivot axis 30 (via the mounting link 44 and rudder member 60 connection), pivoting of the mounting link 44 will not only result in pivoting of the orientation of the surface of the fin 70, but will also raise the level of the fin 70.

Moreover, it has been found that the device 10 positioned and oriented as described herein will not only assist in controlling the boat wake, but will also significantly enhance tracking and maneuverability of the boat by, for example, enabling the boat to be turned at higher speeds through significantly smaller turning radii than could be safely accomplished with a similar boat which does not have the wake control device 10 of the present invention. Further, this may all be accomplished without dangerously adding ballast or ruining gas efficiency.

Figure 6:
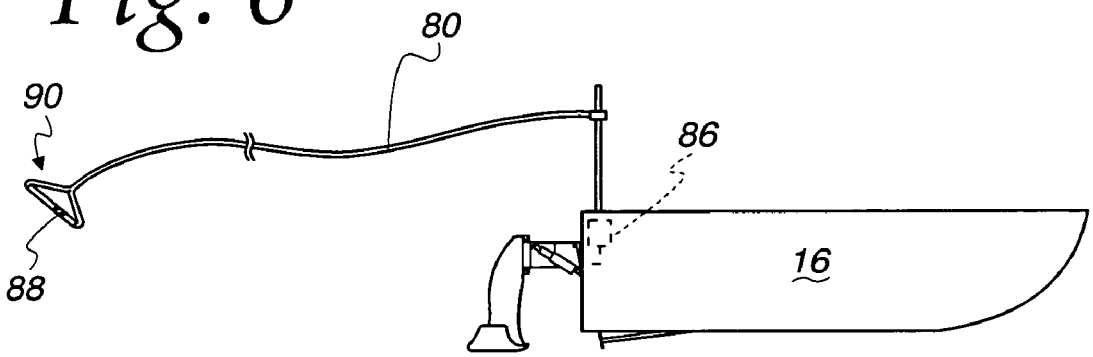
FIG. 6 is a side view of a boat and tow line configuration according to one aspect of the invention.
Figure 7:
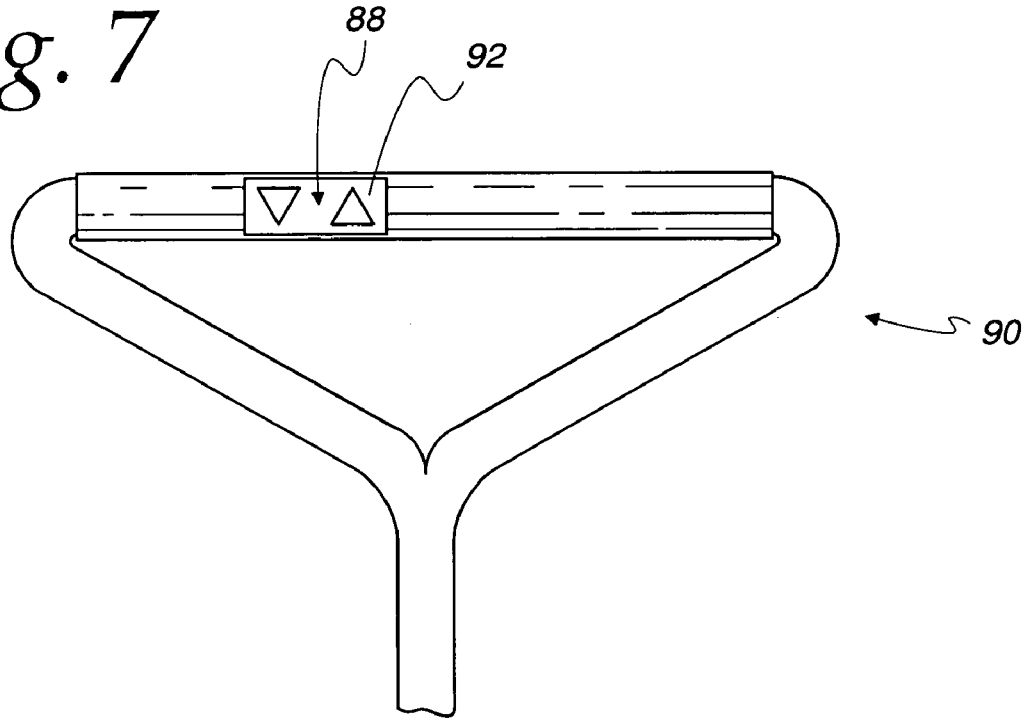
FIG. 7 is an enlarged view of the tow line handle of FIG. 6.

FIGS. 6–7 variously illustrate a boat 16 having the wake control device 10 according to the present invention, with a tow line or rope 80 suitably secured to the boat 16 for pulling a wake boarder or skier. In accordance with this aspect of the invention, a suitable controller 86 connected to the wake control device 10 to control the operation of the drive 50 and thereby the position of the rudder member 60 and fin 70 is remotely controlled by a remote control or remote input device 88 accessible at the wake boarder/skier end of the tow rope 80. This remote input device 88 may be connected to the controller 86 on the boat 16 in any suitable manner including, for example, a wireless connection or a wire connection extending along the length of the tow rope 80.

As illustrated in FIG. 7, the tow rope 80 includes a suitable securement 90 (such as the illustrated handle 90 such as may be grasped by a skier, or a direct attachment of a wake board to the tow rope 80, or other suitable means for a wake boarder or skier to ensure that they will be attached to the rope 80 for towing behind the boat 16). As illustrated, the input device 88 is located on the handle 90 and includes a switch such as a toggle switch 92 whereby toggling the switch 92 one way will pivot the rudder member 60 and fin 70 down within their limits of motion (i.e., will cause the drive 50 to contract or shorten) and toggling the switch 92 the other way will pivot the rudder member 60 and fin 70 up within their limits of motion (i.e., will cause the drive 50 to extend or lengthen, to increase the wake produced by the boat 16). Suitable indicators (such as, as illustrated, an up arrow associated for pivoting the rudder member 60 and fin 70 up to increase the wake size, and a down arrow associated for pivoting the rudder member 60 and fin 70 down to decrease the wake size) may be provided on the switch 92 to facilitate reliable and simple operation. Such indicators may provide not only visual indication but also tactile indication, allowing a wake boarder or skier to operate the switch 92 without looking down at the switch 92.

It should be understood that the remote input/control device 88 illustrated in FIGS. 6–7 is merely an example of one device which may be suitably used with this aspect of the invention. Any device providing the wake boarder or skier the ability to directly control the controller 86 and thereby the wake control device 10 while they are wake boarding or skiing behind the boat would be suitable within the scope of this aspect of the invention. For example, the remote input/control device could be wireless and completely separate from the tow rope 80, enabling each wake boarder and skier to place the device wherever they find most convenient including, for example, secured to the wake board, or their swimsuit. Moreover, the configuration of the remote device and the input controls (e.g., the toggle switch 92) may be of essentially any design which will enable a user to signal the controller 86 and associated wake control device 10 to assume a desired position or configuration.

It should be appreciated that by using a remote input/control device 88 which may be controlled by the wake boarder or skier as they wake board or ski, the wake boarder or skier may ideally control the wake in which they are performing. Thus, the need for the wake boarder or skier to somehow communicate to someone on the boat when wake changes are desired can be avoided, as can the frustration of missed or misunderstood communications. Further, this remote input device 88 will make it much easier for the wake boarder or skier to adjust the wake to exactly the wake they desire, without the yo-yo wake adjustments which can result when a person on board the boat reacts slowly to the wake boarder's or skier's communications to increase or decrease the wake (and thereby increases the wake too much, then decreases it too much, back and forth, until the desired wake is finally achieved). Moreover, it is conceivable that, in certain water conditions, the maximum height wake may be obtained at an intermediate pivoted position of the rudder member 60 and fin 70. In those situation, the use of the remote input/control device 88 enables the wake boarder or skier (who are in the best position to determine the wake height at their location) to readily adjust the device 10 to provide maximum wake height (as is often desired) in conditions where observers on the boat may not be able to determine that proper adjustment.

Figure 8:
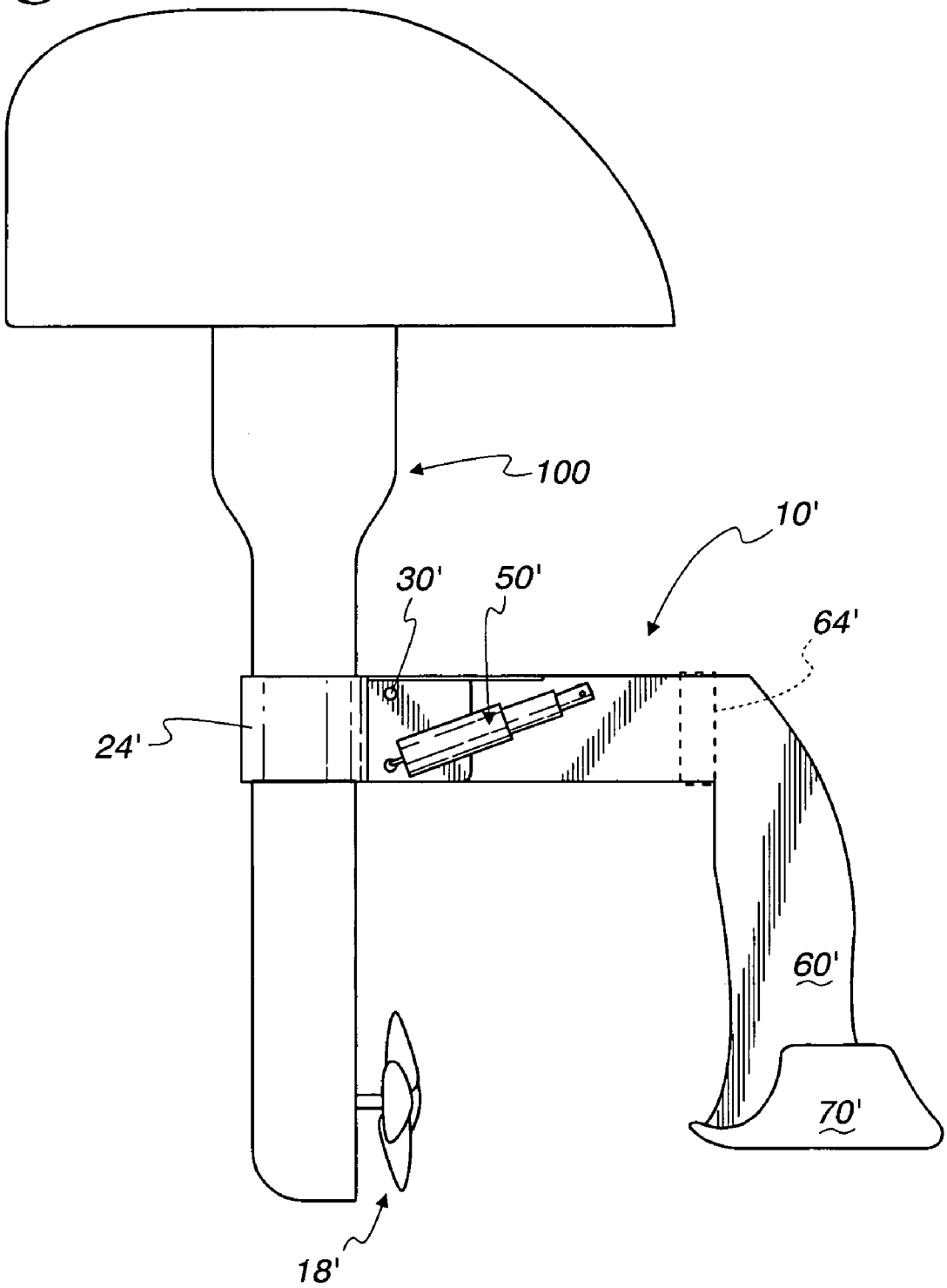
FIG. 8 is side view of an alternative embodiment of the present invention mounted to an outboard motor for a boat.

FIG. 8 illustrates an alternative embodiment in which a wake control device 10' according to the present invention may be used with an outboard motor 100. (For simplicity, components of the FIGS. 1–5 embodiment which are comparable to components of the FIG. 8 embodiment are identified in FIG. 8 using the FIGS. 1–5 reference numerals with prime "'" added.)

In the FIG. 8 embodiment, rather than attaching the device 10' directly to the transom of the boat (not shown in FIG. 8), a suitable mounting bracket 24' is directly secured to the outboard motor 100, with the rudder member 60' and fin 70' advantageously positioned generally in the water stream generated by the propeller 18'. A drive 50' is provided to enable pivoting of the rudder member 60' in accordance with the invention as previously described.

Inasmuch as the device 10' will typically pivot or turn with the outboard motor 100 as it turns, it would be within the scope of the present invention to secure the rudder member 60' for only pivoting about the horizontal first pivot axis 30' (as the rudder member 60' and fin 70' will move with the water stream as the motor 100 turns to change direction of the stream). However, it should be understood that a pivotal connection 64' (shown in phantom in FIG. 8) allowing a limited pivoting of the rudder member 60' about a vertical pivot axis could also be used within the scope of this aspect of the invention.

It should be understood that the wake control device 10' of FIG. 8 may be advantageously used not only with outboard motors as illustrated, but also with inboard/outboard drives (in which the motor is inboard of the boat, but the propeller drive is outside the boat and itself pivots relative to the boat for maneuvering). In either case the device 10' is secured to the outboard portion of the drive supporting the propeller and pivoting for controlled maneuvering of the boat. In that regard, it should therefore also be understood that, as used herein, references to outboard drives include not only outboard motors, but also inboard/outboard drives.

It should also be appreciated that the wake control device 10 according to the present invention which may be not only be provided as original equipment on a boat, but may also be readily retrofitted to an existing boat.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A device for selectively controlling the wake of a boat for a skier or wake boarder being pulled, said boat having an aft and being propelled by a water propulsion device generating a water stream, said device comprising:

a mounting member pivotally securable to the boat aft for pivoting about a first axis substantially transverse to the boat aft;

a rudder member secured to said mounting member for freely pivoting about a second axis substantially perpendicular to said first axis;

a drive selectively controlling the pivotal position of the mounting member about the first axis;

a fin extending laterally relative to said rudder member and being disposed in said water stream when controlling said wake.

2. The device of claim 1, wherein said first and second axes are non-intersecting.

3. The device of claim 1, wherein said second axis is fixed relative to said mounting member.

4. A combination of the device of claim 1 with a boat having a water propulsion drive generating a water stream, wherein said second axis extends through said water stream.

5. A wake control device in combination with a boat having an aft, comprising:

a mounting member pivotally securable to the boat aft for pivoting about a first axis substantially transverse to the boat aft;

a rudder member secured to said mounting member for freely pivoting about a second axis substantially perpendicular to said first axis;

a drive selectively controlling the pivotal position of the mounting member about the first axis;

a fin extending laterally relative to said rudder member; and a water propulsion drive generating a water stream, wherein said second axis extends through said water stream;

wherein said water propulsion drive comprises an inboard motor on said boat.

6. The device of claim 4, wherein said water propulsion device comprises an outboard drive on said boat.

7. A wake control device in combination with a boat having an aft, comprising:

a mounting member pivotally securable to the boat aft for pivoting about a first axis substantially transverse to the boat aft;

a rudder member secured to said mounting member for freely pivoting about a second axis substantially perpendicular to said first axis;

a drive selectively controlling the pivotal position of the mounting member about the first axis;

a fin extending laterally relative to said rudder member; and a water propulsion drive generating a water stream, wherein said second axis extends through said water stream;

wherein said fin is positioned in said water stream.

8. A wake control device in combination with a boat having an aft, comprising:

a mounting member pivotally securable to the boat aft for pivoting about a first axis substantially transverse to the boat aft;

a rudder member secured to said mounting member for pivoting about a second axis substantially perpendicular to said first axis;

a drive selectively controlling the pivotal position of the mounting member about the first axis;

a fin extending laterally relative to said rudder member; and a water propulsion drive generating a water stream, wherein said second axis extends through said water stream;

a controller for said pivotal position controlling drive;

a tow rope secured to said boat at one end and having a securement for a skier or wake boarder remote from said one end; and a manually operable control for said controller located at said tow rope securement.

9. The device of claim 8, further comprising a wire connection along said tow rope connecting said controller and said manually operable control.

10. The device of claim 8, wherein said manually operable control includes a wireless connection to said controller.

11. The device of claim 4, wherein said fin is pivotable about said first axis between a normal position aligned with the bow of the boat and a maximum wake assisting position.

12. The device of claim 11, wherein said normal position and said maximum wake assisting position are pivotally spaced about 12° apart around said first axis.

13. The device of claim 1, wherein said fin is curved upwardly on opposite lateral ends and centered on said rudder member.

14. The device of claim 1, wherein said pivotal position controlling drive comprises at least one selectively expandable drive member having one end pivotally securable to the boat aft and the other end pivotally secured to said mounting member.

15. The device of claim 14, wherein said drive member comprises a first piston and cylinder.

16. The device of claim 15, further comprising a second piston and cylinder, said first and second pistons and cylinders being symmetrically disposed on opposite sides of said mounting member.

17. The device of claim 1, wherein said fin is centered on said rudder member.

18. The device of claim 17, wherein said fin is fixed to the bottom end of said rudder member.

19. A wake control device for a boat propelled by an outboard drive having a propeller drive rotating about a propeller axis, said device comprising:

a rudder member securable to a position spaced behind the outboard drive, said rudder member being pivotable about a lateral axis relative to the out-board drive when secured thereto, said lateral axis being substantially transverse to the outboard drive and perpendicular to said propeller axis, said rudder member further being freely pivotable about a second axis substantially perpendicular to said lateral axis;

a drive selectively controlling the pivotal position of the rudder member about the first axis;

a fin extending laterally relative to said rudder member and defining a surface substantially aligned with said propeller axis when in a normal position.

20. A wake control device for a boat propelled by an outboard drive having a propeller drive rotating about a propeller axis, said device comprising:

a rudder member securable to a position spaced behind the outboard drive, said rudder member being pivotable about a lateral axis relative to the out-board drive when secured thereto, said lateral axis being substantially transverse to the outboard drive and perpendicular to said propeller axis;

a drive selectively controlling the pivotal position of the rudder member about the lateral axis;

a fin extending laterally relative to said rudder member and defining a surface substantially aligned with said propeller axis;

wherein said rudder member is also pivotable about a second axis substantially perpendicular to said lateral axis.

21. A combination of the device of claim 19, outboard drive and propeller, said propeller being adapted to generate a water stream and propel the boat, wherein said fin is positioned in said water stream.

22. A wake control device and an outboard drive having a propeller drive rotating about a propeller axis to generate a water stream for propelling a boat, comprising:

a rudder member securable to a position spaced behind the outboard drive, said rudder member being pivotable about a first axis relative to the outboard drive when secured thereto, said first axis being substantially transverse to the outboard drive and perpendicular to said propeller axis;

a drive selectively controlling the pivotal position of the rudder member about the first axis;

a fin extending laterally relative to said rudder member and defining a surface substantially aligned with said propeller axis, said fin being positioned in said water stream;

a controller for said pivotal position controlling drive; and a remote control for said controller, said remote control being manually operable by a skier or wake boarder remote from the boat.

23. The device of claim 21, wherein said fin is pivotable about said lateral axis between a normal position aligned with the propeller axis and a maximum wake assisting position.

24. The device of claim 23, wherein said normal position and said maximum wake assisting position are pivotally spaced about 12° apart around said lateral axis.

25. A wake control device for a boat propelled by an outboard drive having a propeller drive rotating about a propeller axis, said device comprising:

a rudder member securable to a position spaced behind the outboard drive, said rudder member being pivotable about a first axis relative to the outboard drive when secured thereto, said first axis being substantially transverse to the outboard drive and perpendicular to said propeller axis;

a drive selectively controlling the pivotal position of the rudder member about the first axis;

a fin extending laterally relative to said rudder member and defining a surface substantially aligned with said propeller axis;

wherein said fin is curved upwardly on opposite lateral ends and centered on said rudder member.

26. The device of claim 19, wherein said pivotal position controlling drive comprises at least one selectively expandable drive member having one end pivotally securable to the boat aft and the other end pivotally secured to said mounting member.

27. The device of claim 26, wherein said drive member comprises a first piston and cylinder.

28. A wake control device for a boat propelled by an outboard drive having a propeller drive rotating about a propeller axis, comprising:

a rudder member securable to a position spaced behind the outboard drive, said rudder member being pivotable about a first relative to the outboard drive when secured thereto, said first being substantially transverse to the outboard drive and perpendicular to said propeller axis;

a drive selectively controlling the pivotal position of the rudder member about the first axis;

a fin extending laterally relative to said rudder member and defining a surface substantially aligned with said propeller axis;

wherein said pivotal position controlling drive comprises at least one selectively expandable drive member having one end pivotally securable to the boat aft and the other end pivotally secured to said mounting member, said drive member comprising a first piston and cylinder and a second piston and cylinder, said first and second pistons and cylinders being symmetrically disposed on opposite sides of said mounting member.

29. A wake control device for a boat propelled by an outboard drive having a propeller drive rotating about a propeller axis, said device comprising:

a rudder member securable to a position spaced behind the outboard drive, said rudder member being pivotable about a first relative to the outboard drive when secured thereto, said first being substantially transverse to the outboard drive and perpendicular to said propeller axis;

a drive selectively controlling the pivotal position of the rudder member about the first axis;

a fin extending laterally relative to said rudder member and defining a surface substantially aligned with said propeller axis, wherein said fin is centered on said rudder member.

30. The device of claim 29, wherein said fin is fixed to the bottom end of said rudder member.

31. A device for controlling the wake of a boat, said boat having an aft and being propelled by a water propulsion device generating a water stream, comprising:

a wake assisting device securable to the rear of the boat in said water stream;

a controller for said wake assisting device;

a manually operable control remotely operable by a skier or wake boarder being pulled by the boat for controlling said controller;

a tow rope securable to said boat at one end and having a securement for a skier or wake boarder remote from said one end, wherein said manually operable control is located at said securement; and a wire connection along said tow rope connecting said controller and said manually operable control.

* * * * *